US009301342B2

(12) United States Patent
Miyahara et al.

(10) Patent No.: US 9,301,342 B2
(45) Date of Patent: Mar. 29, 2016

(54) HEATER WIRE

(75) Inventors: Shohei Miyahara, Nagano (JP); Yuichi Nakajo, Nagano (JP); Shigeo Hayashi, Nagano (JP); Shinji Yoda, Nagano (JP)

(73) Assignee: Totoku Electric Co., Ltd., Tokyo (JP)

( * ) Notice: Subject to any disclaimer, the term of this patent is extended or adjusted under 35 U.S.C. 154(b) by 210 days.

(21) Appl. No.: 14/115,511

(22) PCT Filed: May 16, 2012

(86) PCT No.: PCT/JP2012/062537

§ 371 (c)(1),
(2), (4) Date: Nov. 4, 2013

(87) PCT Pub. No.: WO2012/161052

PCT Pub. Date: Nov. 29, 2012

(65) Prior Publication Data

US 2014/0091081 A1 Apr. 3, 2014

(30) Foreign Application Priority Data

May 20, 2011 (JP) ..... 2011-113993

(51) Int. Cl.
*H05B 3/56* (2006.01)
*H05B 3/10* (2006.01)

(52) U.S. Cl.
CPC ... *H05B 3/56* (2013.01); *H05B 3/10* (2013.01)

(58) Field of Classification Search
None
See application file for complete search history.

(56) References Cited

U.S. PATENT DOCUMENTS

| | | | | |
|---|---|---|---|---|
| 3,330,936 | A | 7/1967 | Fickweiler | |
| 4,575,620 | A * | 3/1986 | Ishii et al. | 219/549 |
| 6,144,018 | A * | 11/2000 | Heizer | 219/529 |
| 7,763,804 | B2 * | 7/2010 | Runge | 174/110 R |
| 7,772,493 | B2 * | 8/2010 | Tillner | 174/110 R |
| 2001/0054611 | A1 * | 12/2001 | Miyahara et al. | 219/549 |
| 2002/0195442 | A1 | 12/2002 | Lee | |
| 2008/0047733 | A1 * | 2/2008 | Axakov et al. | 174/110 R |
| 2009/0188231 | A1 | 7/2009 | Song | |
| 2009/0283515 | A1 * | 11/2009 | Sopory et al. | 219/549 |

(Continued)

FOREIGN PATENT DOCUMENTS

| | | |
|---|---|---|
| EP | 0 391 719 | 4/1990 |
| JP | 36-007277 | 4/1961 |

(Continued)

OTHER PUBLICATIONS

Microfilm of the specification and drawings annexed to the requst of Japanese Utility Model Application No. 79485/1985 (Laid-open No. 194985/1986) (Totoku Electric Co., Ltd., Dec. 4, 1986, entire text; all drawings (Family: none).

(Continued)

*Primary Examiner* — Joseph M Pelham
(74) *Attorney, Agent, or Firm* — Jordan and Hamburg LLP

(57) ABSTRACT

A heater wire is obtained by twisting together a plurality of heating element wires in which a rectangular wire is spirally wound around a core wire, and forming an insulating sheath on an outer peripheral surface of the twisted heating element wires. The current carrying capacity can be increased by increasing the number of the heating element wires and there is no need of increasing the cross-sectional area of each of the rectangular wires. Therefore, a reduction in the bending capacity due to an increase in the cross-sectional area of the rectangular wires can be avoided, and the bending capacity can be improved significantly.

6 Claims, 4 Drawing Sheets

(56) References Cited

U.S. PATENT DOCUMENTS

| | | | | |
|---|---|---|---|---|
| 2012/0018420 | A1* | 1/2012 | Whitney et al. | 219/544 |
| 2015/0257205 | A1* | 9/2015 | Hase et al. | 219/539 |

FOREIGN PATENT DOCUMENTS

| | | | | |
|---|---|---|---|---|
| JP | 48-001862 | | 1/1973 | |
| JP | 2-043105 | | 11/1990 | |
| JP | 10-340778 | | 12/1998 | |
| JP | 11204240 | A * | 7/1999 | H05B 3/56 |
| JP | 2004-55179 | | 2/2004 | |
| JP | 2004-211223 | | 7/2004 | |
| WO | WO-2008/023276 | | 2/2008 | |
| WO | WO-2008/059997 | | 5/2008 | |

OTHER PUBLICATIONS

Form PCT/IB/373 International Preliminary Report on Patentability.
Form PCT/ISA/237 Written Opinion.

* cited by examiner

HEATER WIRE

TECHNICAL FIELD

The present invention relates to a heater wire, or more particularly to a heater wire having significantly improved bending capacity even when its current carrying capacity is increased.

BACKGROUND OF THE INVENTION

A heater wire known in the art (see, for example, Patent Document 1) is prepared as follows. A first heater wire is prepared by spirally winding a rectangular wire around a core wire and forming a meltdown layer around these wires, a second heater wire is prepared in the same manner as the first heater wire, the first heater wire and the second heater wire are twisted together, a signal wire is spirally wound around these twisted wires, and an insulating sheath is formed on the peripheral surface of these wires.

PRIOR ART DOCUMENTS

Patent Document

Patent Document 1 Japanese Patent Application Laid-open No. H10-340778

SUMMARY OF THE INVENTION

The above mentioned conventional heater wire includes a single rectangular wire. Therefore, the current carrying capacity and the bending capacity of the heater wire are substantially decided by the cross-sectional area of the rectangular wire. If the cross-sectional area of the rectangular wire is increased in order to increase the current carrying capacity, then the bending capacity decreases significantly.

It is an object of the present invention to provide a heater wire having significantly improved bending capacity even when its current carrying capacity is increased.

According to a first aspect of the present invention, there is provided a heater wire (100) obtained by twisting together a plurality of heating element wires (10) in which a rectangular wire (2) is spirally wound around a core wire (1), and forming an insulating sheath (3) on an outer peripheral surface thereof.

In the heater wire (100) according to the first aspect, the current carrying capacity can be increased by increasing the number of the heating element wires (10). As there is no need to increase the cross-sectional area of each of the rectangular wires (2), the bending capacity can be improved significantly.

According to a second aspect of the present invention, in the heater wire (100) according to the first aspect, there is provided a heater wire (100) in which a direction in which the rectangular wire (2) is wound and a direction in which the heating element wires (10) are twisted are opposite.

In the heater wire (100) according to the second aspect, because the direction in which the rectangular wire (2) is wound and the direction in which the heating element wires (10) are twisted are opposite, tight winding of the rectangular wire (2) does not occur when the heating element wires (10) are twisted, and therefore the flexibility can be maintained. Moreover, because the internal stress (residual stress) generated in the heater wire (100) are cancelled as they have different vector directions, the flexibility of the heater wire (100) can be maintained.

According to a third aspect of the present invention, therein provided a heater wire (200) obtained by twisting together a plurality of heating element wires (20) in which an insulation-coated rectangular wire (4) is spirally wound around a core wire (1), and forming an insulating sheath (3) on an outer peripheral surface thereof.

In the heater wire (200) according to the third aspect, the current carrying capacity can be increased by increasing the number of the heating element wires (20). As there is no need to increase the cross-sectional area of each of the rectangular wires (4), the bending capacity can be improved significantly. Moreover, because the heating element wires (20) are insulated from each other, abnormal heating at the breakage portion can be avoided when one of the heating element wires (20) breaks down.

According to a fourth aspect of the present invention, in the heater wire (200) according to the third aspect, there is provided a heater wire (200) in which a direction in which the rectangular wire (4) is wound and a direction in which the heating element wires (20) are twisted are opposite.

In the heater wire (200) according to the fourth aspect, because the direction in which the rectangular wire (4) is wound and the direction in which the heating element wires (20) are twisted are opposite, tight winding of the rectangular wire (4) does not occur when the heating element wires (20) are twisted, and therefore the flexibility can be maintained. Moreover, because the internal stress (residual stress) generated in the heater wire (200) are cancelled as they have different vector directions, the flexibility of the heater wire (200) can be maintained.

According to the present invention, it is possible to present a heater wire (100, 200) having significantly improved bending capacity even when its current carrying capacity is increased.

DETAILED DESCRIPTION OF THE PREFERRED EMBODIMENTS

Figure 1:
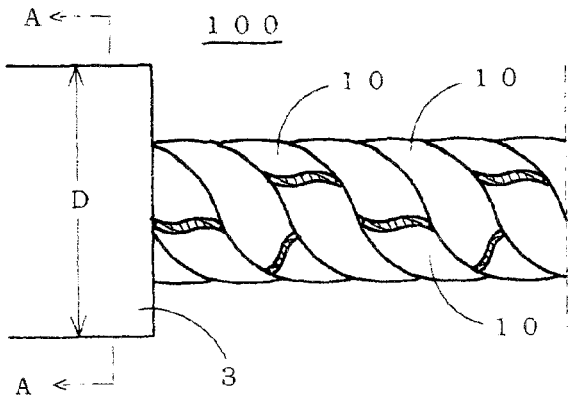
FIG. 1 is a side view of a heater wire according to a first embodiment.

The present invention is described in detail below with reference to the embodiments shown in the drawings. Incidentally, it is not intended that the present invention be limited only to these embodiments.

First Embodiment

FIG. 1 is a side view of a heater wire 100 according to a first embodiment.

The heater wire 100 has a structure in which three heating element wires 10 are twisted together, and an insulating sheath 3 is arranged on a peripheral surface of these wires.

Figure 2:
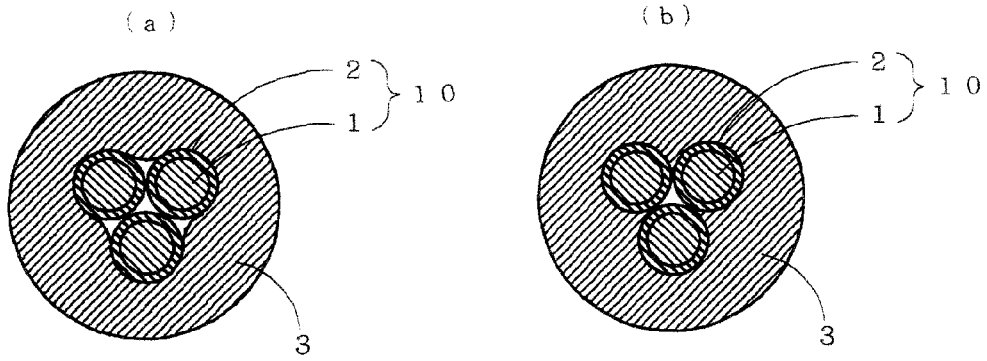
FIG. 2 is a cross-sectional view along a line A-A' shown in FIG. 1.

FIGS. 2(*a*) and (*b*) are cross-sectional views along a line A-A shown in FIG. 1.

Each heating element wire 10 has a structure in which a rectangular wire 2 is spirally wound around a core wire 1.

One method of manufacturing the heater wire 100 is a straw extrusion method in which the three twisted heating element wires 10 are covered by a straw-shaped insulating sheath 3, and this assembly is set in an extrusion device and extruded. When the heater wire 100 is manufactured by the straw extrusion method, the following two situations can occur. That is, as shown in FIG. 2(*a*), a hollow space is generated in a central portion that is surrounded by the three heating element wires 10 as well as hollow spaces are generated in a valley portion between adjacent heating element wires 10, and, as shown in FIG. 2(*b*), a hollow space is generated only in a central portion that is surrounded by the three heating element wires 10. When the insulating sheath 3 is formed on a peripheral surface of the three twisted heating element wires 10 by ordinary extrusion, as shown in FIG. 2(*b*), the hollow space is generated only in the central portion that is surrounded by the three heating element wires 10.

When, as shown in FIG. 2(*a*), the hollow spaces are generated in the central portion that is surrounded by the three heating element wires 10 as well as the hollow space is generated in the valley portion between the adjacent heating element wires 10, the cross-section of the heater wire 100 could become non-circular. When such a wire having a non-circular cross-section is laid out on a flat surface, a surface area that is in contact with the flat surface will be larger for this wire than for a wire having a circular cross-section, and therefore such a wire will exhibit better heat transfer efficiency.

Figure 3:
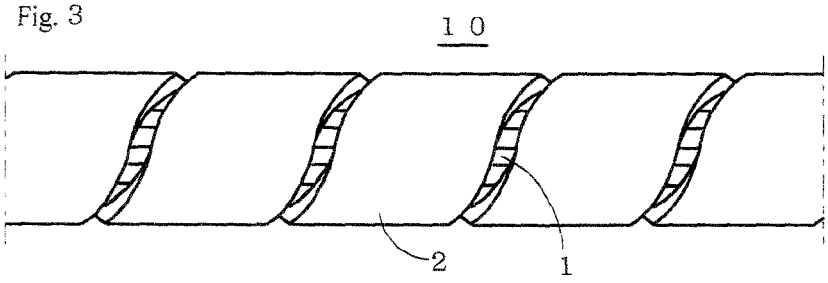
FIG. 3 is a side view of a heating element wire according to the first embodiment.
Figure 4:
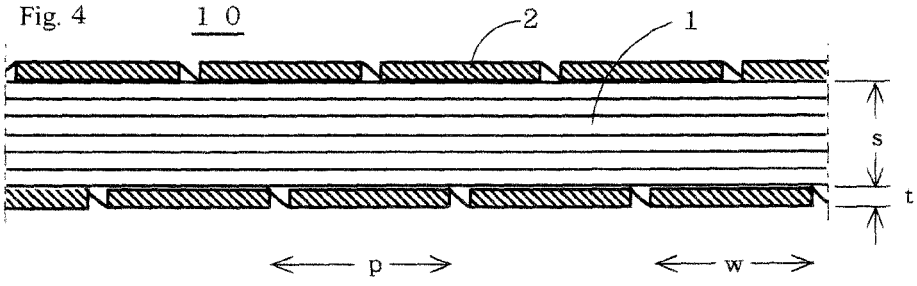
FIG. 4 is a vertical cross-sectional view of the heating element wire shown in FIG. 3.

FIG. 3 is a side view of the heating element wire 10. FIG. 4 is a vertical cross-sectional view of the heating element wire 10.

A direction in which the rectangular wire 2 is spirally wound around in the heating element wire 10 and a direction in which the three heating element wires 10 are twisted in the heater wire 100 are opposite.

The core wire 1 is, for example, made of polyarylate fiber. The core wire 1 has an outer diameter s, for example, between 0.10 millimeter (mm) and 0.27 mm.

The rectangular wire 2 is, for example, an annealed copper rectangular wire. The rectangular wire 2 has a thickness t, for example, between 0.023 mm and 0.060 mm, and a width w, for example, between 0.15 mm and 0.75 mm.

Thus, "the thickness t of the rectangular wire/the outer diameter s of the core wire" is between 0.085 and 0.600, "the width w of the rectangular wire/the outer diameter s of the core wire" is between 0.556 and 7.500, and "the width w of the rectangular wire/the thickness t" is between 5.00 and 15.00.

The insulating sheath 3 is, for example, made of polyamide resin, and is formed by extrusion.

The heater wire 100 has an outer diameter D of, for example, 0.9 mm.

Figure 5:
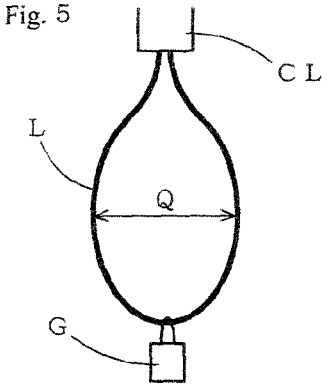
FIG. 5 is a diagram for explaining a method of measuring the flexibility of the heater wire.

FIG. 5 is a diagram for explaining a method of measuring the flexibility.

(1) The heater wire 100 having a length of 700 mm is suspended from a clamp CL in the form of a loop L.

(2) The lower end of the loop L is pulled down by applying a load G of 2 grams (g).

(3) A horizontal distance Q of the loop L is measured.

An experiment for measuring the flexibility was conducted at a temperature of 22 degrees Celsius on a heater wire 100 having certain dimensions. The dimensions of the heater wire 100 were as follows: the outer diameter s of the core wire=0.17 mm, the thickness t of the rectangular wire=0.027 mm, the width w of the rectangular wire=0.32 rum, a winding pitch p of the rectangular wire=0.45 mm, "the thickness t of the rectangular wire/the outer diameter s of the core wire"=0.159, "the width 2 of the rectangular wire the outer diameter s of the core wire"=1.882, "the with w of the rectangular wire/the thickness t"=11.85. The horizontal distance Q was found to be 82.7 mm.

Figure 6:
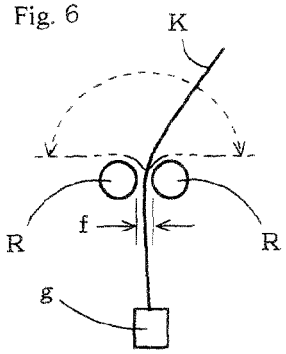
FIG. 6 is a diagram for explaining a method of measuring the bending capacity of the heater wire.

FIG. 6 is a diagram for explaining a method of measuring the bending capacity.

(1) A heater wire K is passed between two rollers R and the lower end of the heater wire K is pulled by applying a load q of 500 g. The rollers R have a radius of 5 mm, and they were arranged with a gap of 2.5 mm therebetween.

(2) The upper end of the heater wire K is bent from 90 degrees on left to 90 degrees on right and this process was repeated until the wire broke. A reciprocating number representing the number of times the wire made a to-and-fro motion before it broke was counted.

An experiment for measuring the bending capacity was conducted at a temperature of 22 degrees Celsius on a heater wire 100 having an outer diameter D of 0.9 mm and in which each of the three heating element wires 10 had certain dimensions. The dimensions of the heating element wires 10 were as follows: the outer diameter s of the core wire=0.17 mm, the thickness t of the rectangular wire=0.027 mm, the width w of the rectangular wire=0.45 mm, "the thickness t of the rectangular wire/the outer diameter s of the core wire"=0.159, "the width w of the rectangular wire/the outer diameter s of the core wire"=1.882, "the width w of the rectangular wire/the thickness t"=11.85. It was found that the heater wire 100 did not break even when the reciprocating number reached 1,50,000.

A bending radius R in the above experiment for measuring the bending capacity is 5 mm, so that a bending circumference ($2\pi \cdot R$) of the heater wire 100 would be 31.4 mm. Accordingly, "the outer diameter C of the heater wire 100/the bending circumference of the heater wire 100" would be 2.9%. If "the outer diameter D of the heater wire 100/the bending circumference of the heater wire 100" is 2.9% or below, the conditions will be more relaxed than the conditions used in the above experiment, so that the wire will not break even for a reciprocating number of 1,50,000.

As a first comparative example, an experiment for measuring the bending capacity was conducted at a temperature of 22 degrees Celsius on a heater wire having only one heating element wire 10 having certain dimensions. The dimensions of the heating element wire 10 were as follows: the outer diameter s of the core wire=0.17 mm, the thickness t of the rectangular wire=0.027 mm, the width w of the rectangular wire=0.31 mm, and the winding pitch p of the rectangular wire=0.45 mm. This wire broke at a reciprocating number of 41,500. This means that, the current carrying capacity (conducting surface area) increased about 3.1 times and the bending capacity increased about 3.8 times or more in the heater wire 100 of the first embodiment as compared to the heater wire of the first comparative example, As a second comparative example, an experiment for measuring the bending capacity was conducted at a temperature of 22 degrees Celsius on a heater wire having only one heating element wire 10 having certain dimensions. The dimensions of the heating element wire 10 were as follows: the outer diameter s of the core wire=0.17 mm, the thickness t of the rectangular wire=0.060 mm, the width w of the rectangular wire=036 mm, and the winding pitch p of the rectangular wire=0.45 mm. This wire broke at a reciprocating number of 18,300. This means that, the current carrying capacity (conducting surface area) increased 1.2 times and the bending capacity increased about 8.2 times or more in the heater wire 100 of the first embodiment as compared to the heater wire of the second comparative example.

The heater wire 100 of the first embodiment has the following advantages.

(1) The current carrying capacity is increased by increasing the number of the heating element wires 10 and there is no need of increasing the cross-sectional area of each of the rectangular wires 2. This leads to significant improvement in the bending capacity.

(2) Tight winding of the rectangular wire 2 does not occur when the heating element wires 10 are twisted. This leads to maintaining the flexibility.

Second Embodiment

Figure 7:
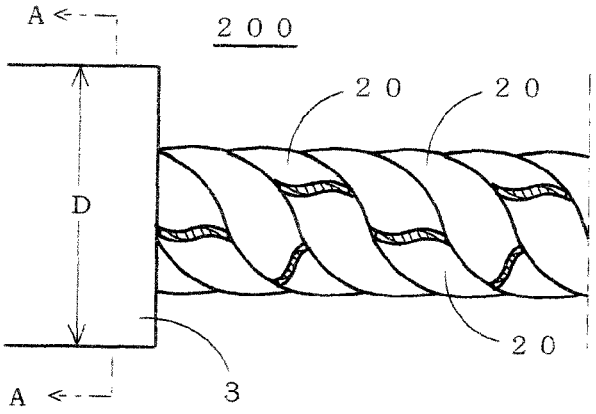
FIG. 7 is a side view of a heater wire according to a second embodiment.

FIG. 7 is a side view of is heater wire 200 according to a second embodiment.

The heater wire 200 has a structure in which three heating element wires 20 are twisted together, and the insulating sheath 3 is arranged on a peripheral surface of these wires.

Figure 8:
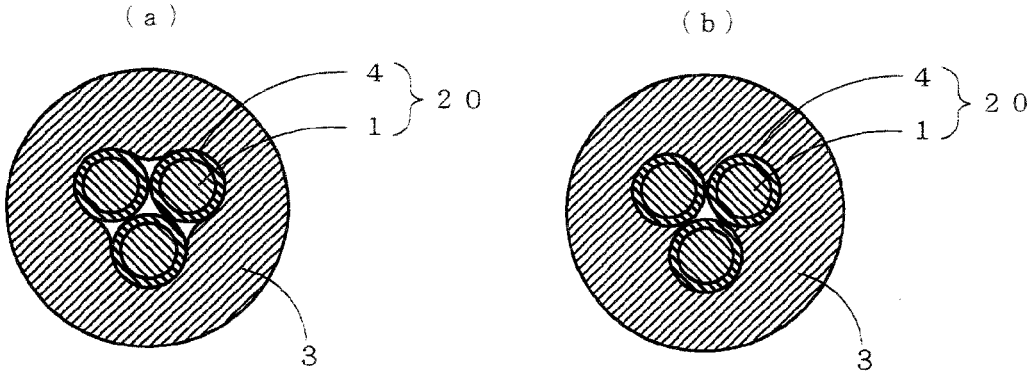
FIG. 8 is a cross-sectional view along a line A-A' shown in FIG. 7.

FIGS. 8(*a*) and (*b*) are cross-sectional views along a line A-A shown in FIG. 7.

The heating element wire 20 has a structure in which an enamel-coated rectangular wire 4 is spirally wound around the core wire 1.

One method of manufacturing the heater wire 200 is the straw extrusion method in which the three twisted heating element wires 20 are covered a straw-shaped insulating sheath 3, and this assembly is set in an extrusion device and extruded. When the heater wire 200 is manufactured by the straw extrusion method, the following two situations can occur. That is, as shown in FIG. 8(*a*), a hollow space is generated in a central portion that is surrounded by the three heating element wires 20 as well as hollow spaces are generated in a valley portion between adjacent heating element wires 20, and, as shown in FIG. 8(*b*), a hollow space is generated only in a central portion that is surrounded by the three heating element wires 20. When the insulating sheath 3 is formed on a peripheral surface of the three twisted heating element wires 20 by ordinary extrusion, as shown in FIG. 8(*b*), the hollow space is generated only in the central portion that is surrounded by the three heating element wires 20.

When, as shown in FIG. 8(*a*), the hollow spaces are generated in the central portion that is surrounded by the three heating element wires 20 as well as the hollow space is generated in the valley portion between the adjacent heating element wires 20, the cross-section of the heater wire 200 could become non-circular. When such a wire having a non-circular cross-section is laid out on a flat surface, a surface area that is in contact with the flat surface will be larger for this wire than for a wire having a circular cross section, and therefore such a wire will exhibit better heat transfer efficiency.

Figure 9:
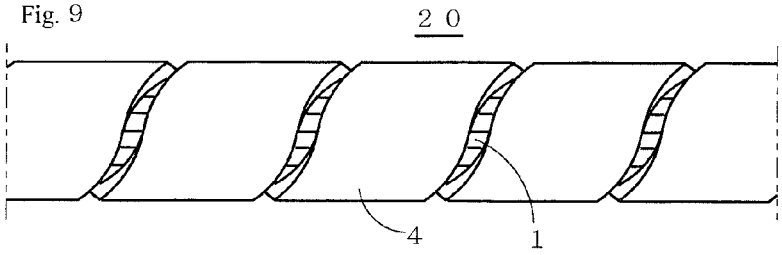
FIG. 9 is a side view of a heating element wire according to the second embodiment.
Figure 10:
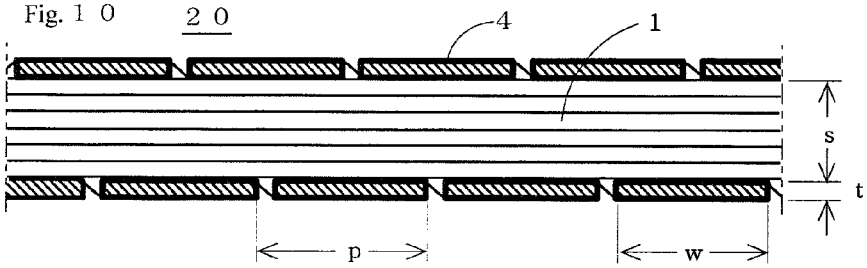
FIG. 10 is a vertical cross-sectional view of the heating element wire shown in FIG. 9.

FIG. 9 is a side view of the heating element wire 20. FIG. 10 is a vertical cross-sectional view of the heating element wire 20.

A direction in which the enamel-coated rectangular wire 4 is spirally wound in the heating element wire 20 and a direction in which the three heating element wires 20 are twisted in the heater wire 200 are opposite.

The core wire 1 is, for example, made of polyarylate fiber. The core wire 1 has an outer diameter s, for example, between 0.10 mm and 0.27 mm.

The enamel-coated rectangular wire 4 is, for example, an annealed copper rectangular wire having a coating of polyester imide resin. The enamel-coated rectangular wire 4 has a thickness t, for example, between 0.023 mm and 0.060 mm, and a width w, for example, between 0.15 mm and 0.75 mm.

Thus, "the thickness t of the rectangular wire/the outer diameter s of the core wire" is between 0.085 and 0.600, "the width w of the rectangular wire/the outer diameter s of the core wire" is between 0.556 and 7.500, and "the width w of the rectangular wire/the thickness t" is between 5.00 and 15.00.

The insulating sheath 3 is made of, for example, polyamide resin, and is formed by extrusion.

The heater wire 200 has an outer diameter of, for example, 0.9 mm.

An experiment for measuring the flexibility explained with reference to FIG. 5 was conducted on the heater wire 200. The results were not much different from those for the heater wire 100 of the first embodiment. Moreover, an experiment for measuring the bending capacity explained with reference to FIG. 6 was conducted on the heater wire 200. The heater wire 200 did not break even when the reciprocating number reached 6,00,000.

As a third comparative example, an experiment for measuring the bending capacity was conducted at a temperature of 22 degrees Celsius on a heater wire having only one heating element wire 20 having certain dimensions. The dimensions of the heating element wire 20 were as follows: the outer diameter s of the core wire=0.17 mm, the thickness t of the rectangular wire=0.027 mm, the width w of the rectangular wire=0.31 mm, and the winding pitch p of the rectangular wire=0.45 mm. This wire broke at a reciprocating number of 1,66,000. This means that, the current carrying capacity (conducting surface area) increased about 3.1 times and the bending capacity increased about 3.6 times or more in the heater wire 200 of the second embodiment as compared to the heater wire of the third comparative example.

As a fourth comparative example, an experiment for measuring the bending capacity was conducted at a temperature of 22 degrees Celsius on a heater wire having only one heating element wire 20 having certain dimensions. The dimensions of the heating element wire 20 were as follows: the outer diameter s of the core wire=0.17 mm, the thickness t of the rectangular wire=0,060 mm, the width w of the rectangular wire=036 mm, and the winding pitch p of the rectangular wire=0.45 mm. This wire broke at a reciprocating number of 73,200. This means that, the current carrying capacity (conducting surface area) increased 1.2 times and the bending capacity increased about 8.2 times or more in the heater wire 200 of the second embodiment as compared to the heater wire of the fourth comparative example.

The bending capacity of the heater wire 200 of the second embodiment increased 14 times or more as compared to the same for the first comparative example and increased 32 times or more as compared to the same for the second comparative example.

The heater wire 200 of the second embodiment has the following advantages in addition to the advantages of the first embodiment.

(1) The current carrying capacity is increased by increasing the number of the heating element wires 20 and there is no need of increasing the cross-sectional area of each of the enamel-coated rectangular wires 4. This leads to significant improvement in the bending capacity, (2) Tight winding of the enamel-coated rectangular wire 4 does not occur when the heating element wires 20 are twisted. This leads to maintaining the flexibility.

(3) The heating element wires 20 are insulated from each other. Therefore, abnormal heating at the breakage portion can be avoided even when one of the heating element wires 20 breaks down.

Third Embodiment

Figure 11:
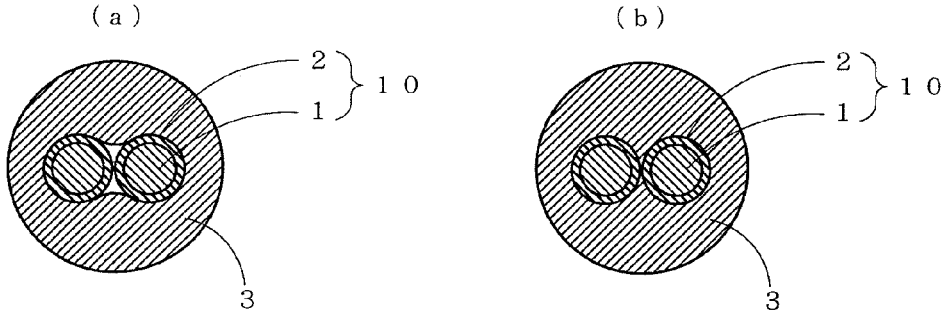
FIG. 11 is a cross-sectional view of a heater wire according to a third embodiment.

When the desired current carrying capacity is small, as shown in FIG. 11, minimal two heating element wires 10 (or 20) could be used.

One method of manufacturing the heater wire 100 (or 200) is the straw extrusion method in which the two twisted heating element wires 10 (or 20) are covered by a straw-shaped insulating sheath 3, and this assembly is set in an extrusion device and extruded. When the heater wire 100 (or 200) is manufactured by the straw extrusion method, the following two situations can occur. That is, as shown in FIG. 11(*a*), a hollow space is generated in a valley portion between the two heating element wires 10 (or 20), and, as shown in FIG. 11(*b*), a hollow space is not generated in the valley portion between the two heating element wires 10 (or 20). When the insulating sheath 3 is formed on a peripheral surface of the two twisted heating element wires 10 (or 20) by ordinary extrusion, as shown in FIG. 11(*b*), a hollow space is not generated in the valley portion between the two heating element wires 10 (or 20).

When, as shown in FIG. 11(*a*), the hollow space is generated in the valley portion between the two heating element wires 10 (or 20), the cross-section of the heater wire 100 (or 200) could become non-circular. When such a wire having a non-circular cross-section is laid out on a flat surface, a surface area that is in contact with the flat surface will be larger for this wire than for a wire having a circular cross-section, and therefore such a wire will exhibit better heat transfer efficiency.

Fourth Embodiment

Figure 12:
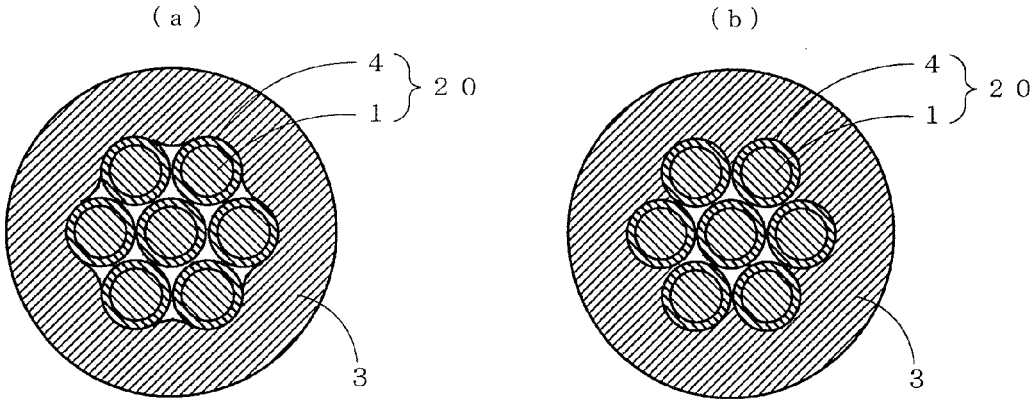
FIG. 12 is a cross-sectional view of a heater wire according to a fourth embodiment.

When the desired current carrying capacity is large, as shown in FIG. 12, four or more heating element wires 20 (or 10) could be used.

One method of manufacturing the heater wire 200 (or 100) is the straw extrusion method in which the four or more twisted heating element wires 20 (or 10) are covered by a straw-shaped insulating sheath 3, and this assembly is set in an extrusion device and extruded. When the heater wire 200 (or 100) is manufactured by the straw extrusion method, the following two situations can occur. That is, as shown in FIG. 12(*a*), a hollow space is generated in a central portion that is surrounded by the seven heating element wires 20 (or 10) as well as a hollow space is generated in a valley portion between adjacent heating element wires 20 (or 10), and, as shown in FIG. 12(*b*), a hollow space is generated only in a central portion that is surrounded by the seven heating element wires 20 (or 10). When the insulating sheath 3 is formed on a peripheral surface of the seven twisted heating element wires 20 (or 10) by ordinary extrusion, as shown in FIG. 12(*b*), the hollow space is generated only in the central portion that is surrounded by the seven heating element wires 20 (or 10).

When, as shown in FIG. 12(*a*), the hollow spaces are generated in the central portion that is surrounded by the seven heating element wires 20 (or 10) as well as the hollow space is generated in the valley portion between the adjacent heating element wires 20 (or 10), the cross-section of the heater wire 200 (or 100) could become non-circular. When such a wire having a non-circular cross-section is laid out on a flat surface, a surface area that is in contact with the flat surface will be larger for this wire than for a wire having a circular cross-section, and therefore such a wire will exhibit better heat transfer efficiency.

In case of the heating element wires shown in FIGS. 12 (*a*) and (*b*), a heating element wire 20 (or 10) located at the center can be changed to the core wire 1 to prevent excess heating of the heating element wire 20 (or 10) located at the center.

INDUSTRIAL APPLICABILITY

The heater wire according to the present invention can be used as a planer heater in appliances such as electric blankets, electric carpets, automobile seat heaters, toilet seat heaters, water heaters for warm water flushing toilets, heaters used in copying machines, heaters used in automatic vending machines, heaters used as instantaneous heaters.

DESCRIPTION OF REFERENCE NUMERALS

1 Core wire
2 Rectangular wire
3 insulating sheath
4 Enamel-coated rectangular wire
10, 20 Heating element wire
100, 200 Heater wire

The invention claimed is:

1. A heater wire comprising:
a plurality of heating elements twisted together to form a twisted set of heating elements; and
an insulating sheath formed on an outer peripheral surface of the twisted set; and
wherein each one heating element among said plurality of heating elements consists of a core wire and a rectangular wire spirally wound around the core wire.

2. The heater wire according to claim 1, wherein a direction in which the rectangular wire is wound and a direction in which the heating element wires are twisted are opposite.

3. The heater wire according to claim 2, wherein the plurality of heating elements twisted together form a structure having a central portion that is a first hollow space, the first hollow space being surrounded by the plurality of heating elements, and wherein a plurality of second hollow spaces are formed in a valley surrounded by adjacent heating element wires and the insulating sheath.

4. A heater wire comprising:
a plurality of heating elements twisted together; and
an insulating sheath formed on an outer peripheral surface of the twisted heating elements; and
wherein each one heating element among said plurality of heating elements consists of a core wire and an insulation-coated rectangular wire spirally wound around the core wire.

5. The heater wire according to claim 4, wherein a direction of the insulation-coated rectangular wire is wound and a direction in which the heating elements are twisted are opposite.

6. The heater wire according to claim 4, wherein the plurality of heating elements twisted together form a structure having a central portion that is a first hollow space, the first hollow space being surrounded by the plurality of heating elements, and wherein a plurality of second hollow spaces are formed in a valley surrounded by adjacent heating element wires and the insulating sheath.

* * * * *